US007608235B2

(12) United States Patent
Tasaka et al.

(10) Patent No.: US 7,608,235 B2
(45) Date of Patent: Oct. 27, 2009

(54) CARBON ELECTRODE FOR GENERATION OF NITROGEN TRIFLUORIDE GAS

(75) Inventors: Akimasa Tasaka, Kyoto (JP); Masashi Kodama, Osaka (JP); Udai Tanaka, Osaka (JP); Hitoshi Takebayashi, Osaka (JP); Tetsuro Tojo, Osaka (JP); Atsuhisa Mimoto, Tokyo (JP)

(73) Assignees: Toyo Tanso Co., Ltd., Osaka-shi (JP); Mitsui Chemicals, Inc., Tokyo (JP)

( * ) Notice: Subject to any disclaimer, the term of this patent is extended or adjusted under 35 U.S.C. 154(b) by 0 days.

(21) Appl. No.: 11/572,938

(22) PCT Filed: Aug. 3, 2005

(86) PCT No.: PCT/JP2005/014197

§ 371 (c)(1),
(2), (4) Date: Jan. 30, 2007

(87) PCT Pub. No.: WO2006/013888

PCT Pub. Date: Feb. 9, 2006

(65) Prior Publication Data

US 2007/0199828 A1 Aug. 30, 2007

(30) Foreign Application Priority Data

Aug. 5, 2004 (JP) ..... 2004-229326

(51) Int. Cl.
*C01B 21/088* (2006.01)
*C25B 1/24* (2006.01)
*C25B 1/00* (2006.01)

(52) U.S. Cl. ..... 423/383; 205/359; 205/360; 205/411

(58) Field of Classification Search ..... 423/383; 204/294; 205/411, 359, 360
See application file for complete search history.

(56) References Cited

FOREIGN PATENT DOCUMENTS

| | | |
|---|---|---|
| JP | 56 23285 | 3/1981 |
| JP | 2 47297 | 2/1990 |
| JP | 3 232988 | 10/1991 |
| JP | 5 5194 | 1/1993 |
| JP | 2001 295086 | 10/2001 |

*Primary Examiner*—Jafar Parsa
(74) *Attorney, Agent, or Firm*—Oblon, Spivak, McClelland, Maier & Neustadt, L.L.P.

(57) ABSTRACT

A carbon electrode for producing gaseous nitrogen trifluoride comprising a dense texture with an average pore size of 0.5 μm or less is provided. The carbon electrode contains a carbonaceous material, and 3 to 10 wt % of at least one selected from magnesium fluoride and aluminum fluoride which have a melting point not lower than the baking temperature of the carbonaceous material.

2 Claims, No Drawings

CARBON ELECTRODE FOR GENERATION OF NITROGEN TRIFLUORIDE GAS

FIELD OF THE INVENTION

The present invention relates to a carbon electrode for producing gaseous nitrogen trifluoride (hereinafter, sometimes referred to as $NF_3$).

BACKGROUND ART

There have been known a carbon electrode for producing gaseous nitrogen trifluoride and a generator for producing gaseous nitrogen trifluoride using the same. For example, a carbon electrode for producing gaseous nitrogen trifluoride has been disclosed in the following Patent Document 1. This shows a carbon electrode for producing gaseous fluorine or gaseous nitrogen trifluoride, containing a carbonaceous material, lithium fluoride and a metal fluoride having a melting point not lower than a baking temperature of the carbonaceous material, wherein the content of two-component metal fluoride which contains the lithium fluoride and the metal fluoride is 0.1 to 5 mass %. Also, the following Patent Document 2 proposes a method for impregnating a metal fluoride such as lithium fluoride, sodium fluoride, aluminium fluoride and magnesium fluoride in a carbon electrode to suppress the polarization of the carbon electrode.

[Patent Document 1]

Japanese Published Unexamined Patent Application No. 2001-295086

[Patent Document 2]

Japanese Published Unexamined Patent Application No. H5-5194

DISCLOSURE OF THE INVENTION

Problems to the Solved by the Invention

However, the metal fluoride disclosed in the Patent Document 1 contains an eutectic series of lithium fluoride and calcium fluoride. This eutectic metal fluoride requires the steps of respectively melting the lithium fluoride and the calcium fluoride at a higher temperature than the melting points thereof and further grinding the produced eutectic metal fluoride, mixing the eutectic metal fluoride with the carbon material, and baking the resultant mixture. Thereby, the method becomes complex or expensive.

Also, the carbon electrode containing the lithium fluoride as shown in the Patent Document 2 suppresses the generation of covalently-bonded graphite fluoride as shown in the following formula (3), and the generation reactions of a fluoride-graphite intercalation compound as shown in the formulae (1) and (2) mainly occur. The covalently-bonded graphite fluoride generated on the surface of this electrode causes polarization (the very low surface energy generates an anode effect.). Thus, although the lithium fluoride has an effect for suppressing the polarization, the pores of the carbon electrode containing the calcium fluoride are increased. The texture itself of the carbon electrode is also porous, and the strength thereof is low. Therefore, during electrolysis, the disintegrating of the electrode has often been caused. An $NH_4F$—HF series is generally used for an electrolytic bath for producing $NF_3$. This bath has low viscosity and high activity of HF. Therefore, in the above carbon electrode containing the calcium fluoride, the HF permeates in the pores thereof, and the electrolysis in fine pores proceeds. Then, a fluoride-graphite intercalation compound (a first stage) as shown in the following formulae (1) and (2) occurs. The first stage compound is formed by inserting intercalant into each of the graphite layers, and the material largely swells to bring about the disintegrating of the texture.

[Formula 1]

$$\chi C+HF_2^- \rightarrow C_\chi^+ HF_2^- + e^- \quad (1)$$

[Formula 2]

$$xC_xF \xrightarrow{MF} C_x^+ F^- \quad (2)$$

[Formula 3]

$$nC+nF^- \rightarrow (CF)_n + ne^- \quad (3)$$

Therefore, it is an object of the present invention to produce a carbon electrode having a texture with reduced pores and having relatively high mechanical strength only by being subjected to a process where a specified metal fluoride is mixed with a carbon material, then the mixture is baked, and to newly create a carbon electrode for producing a carbon electrode having a long life without the polarization of the carbon electrode even in any case of an $NH_4$—KF—HF series and an $NH_4F$—HF series.

Means for Solving the Problems

In order to solve the above problems, the present invention can provide a carbon electrode which can solve the above problems. That is, the prevention of the infiltration of the electrolyte (liquid) into the pores of the carbon electrode and the suppression of the polarization by further examining the type of the metal fluoride contained in the carbon electrode and the content thereof, and the present invention has been accomplished.

That is, the subject matter of the present invention is a carbon electrode having a dense texture with an average pore size of 0.5 μm or less. The average pore size exceeding 0.5 μm causes the infiltration of the electrolyte into the carbon electrode to disintegrate the electrode. The average pore size of the carbon electrode was measured by a mercury pressurizing method. A pore diameter whose value shows equivalent to half of a cumulative pore volume was defined as an average pore size.

Also, the carbon electrode for producing gaseous nitrogen trifluoride of the present invention includes a carbonaceous material, and at least one of more kinds selected from magnesium fluoride and aluminum fluoride respectively having a melting point not lower than a baking temperature of the carbonaceous material. When the magnesium fluoride and the aluminium fluoride are contained up to the central part of the carbon electrode, the magnesium fluoride and the aluminium fluoride are microscopically trapped between graphite layers of which the carbon electrode is made to form a graphite intercalation compound of a moderate stage, and thereby the polarization can be suppressed This means that expensive lithium fluoride which has been mainly used a polarization suppressant until now can be replaced with the magnesium fluoride and the aluminium fluoride, and is economically advantageous. The magnesium fluoride and the aluminium fluoride can be used by mixing them. (When a metal fluoride $MF_m$) such as magnesium fluoride and the aluminum fluoride exists on the surface of the electrode, the metal fluoride has a high-degree oxidation state as shown in the following formula (4). This metal fluoride having the high-degree oxidation state forms an active complex of the following formula (5). Furthermore, the active complex becomes a fluoride-graphite intercalation compound. The metal fluoride is catalytically returned to the original state.)

[Formula 4]

$$MF_m + \frac{x}{2}F_2 \rightarrow MF_{m+x} \quad (4)$$

[Formula 5]

$$nC + MF_{m+x} + \frac{y}{2}F_2 \rightarrow C_nF_{x+y}(MF_m) \quad (5)$$

[Formula 6]

$$C_nF_{x+y}(MF_m) \rightarrow C_n^+F_+ + MF_m \quad M\ (6)$$

Also, the present invention uses an $NH_4F$—KF—HF series for the electrolyte. The viscosity of the electrolyte of the $NH_4F$—HF series is increased by adding potassium fluoride into the electrolyte to suppress the infiltration of the electrolyte into the pores of the carbon. As a result, an HF activity in the pores of the carbon can be reduced, and the disintegrating of the electrode in the electrolysis can be suppressed.

Also, the content of at least one of more kinds selected from the magnesium fluoride and the aluminum fluoride is 3 to 10 wt %. When the content of at least one or more kinds selected from the magnesium fluoride and the aluminium fluoride is lower than 3 wt %, an effect as a catalytic action of the metal fluoride for generating a fluoride-graphite intercalation compound is not fully exerted. Also, when the content of at least one or more kinds selected from the magnesium fluoride and the aluminium fluoride is more than 10 wt %, it is not preferable because the strength of the electrode itself is decreased.

Effects of the Invention

Since the present invention has no process for preparing the eutectic metal fluoride, it is possible to produce the electrode very simply and inexpensively.

Also, since the carbon electrode of the present invention has higher physical strength than that of the carbon electrode containing the calcium fluoride, the longer life of the electrode and the longer-term continuation of the electrolysis can be attained. A mono-component series also has a catalytic action for generating a fluoride-carbon intercalation compound having a C—F bond of an ionic bond and half covalently-bonded, and can suppress the generation of the anode effect. When this reaction advances moderately, the reaction contributes to the polar-term increase of the surface of the electrode material, and exerts effects for enhancing the wettability of the electrolyte and electrode and suppressing the polarization of the electrode. However, as described above, the generation of the first stage compound causes the swelling of the material, and this results in the disintegrating of the material. It has been found that the generated compound is inhibited to a third stage compound by adding $AlF_3$ and $MgF_2$ of which a catalyst capability for the generating reaction of the fluoride-graphite intercalation compound is milder than that of LiF. Therebye, the wettability of the electrolyte and electrode can be maintained, and the polarization of the fluoride-graphite intercalation compound can be suppressed without causing the disintegrating of the electrode. Also, the strength of the electrode is not decreased by adding $AlF_3$ and $MgF_2$. The electrode that can be electrolyzed for a long period of time is obtained while the yield of the $NF_3$ in the $NH_4$—HF series is maintained by adding KF to increase the viscosity in these synthetic effects.

Best Mode for Carrying Out the Invention

Next, a carbon electrode according to an embodiment of the present invention will be described.

Examples of methods for producing the carbon electrode according to the embodiment of the present invention include the following. Magnesium fluoride (hereinafter, referred to as $MgF_2$) or aluminum fluoride (hereinafter, referred to as $AlF_3$) which respectively has a melting point not lower than a baking temperature of a carbonaceous material is selected. Alternatively, a specified amount of at least one or more kinds thereof is uniformly mixed. Next, 3 to 10 wt % of the above metal fluoride or mixture of the metal fluorides is mixed with meso carbon micro beads as the carbonaceous material, and the resultant mixture is formed and baked to form a carbon compact. This carbon compact is subjected to CIP compacting at a pressure of 80 to 100 MPa. The carbon compact is then baked at 800 to 1000° C., and is processed into a predetermined shape. However, the electrode used in the present invention is not limited to the above producing method.

According to the above composition, in the carbon electrode according to the embodiment of the present invention, the generation of an anode effect is suppressed by adding magnesium fluoride or aluminum fluoride into an electrode without using lithium fluoride as a metal fluoride which has a catalytic action for generating a carbon-graphite interlaminar compound. Furthermore, since then strength of the electrode is a larger than that of the carbon electrode containing lithium fluoride-calcium fluoride, the electrode has a longer life.

EXAMPLES

Examples 1 to 7 and Comparative Examples 1 to 7

5.0 wt % of $AlF_3$ having an average particle size of 10 μm was added with meso carbon micro beads having an average particle size of 15 μm as a carbonaceous material, and they were uniformly mixed using a mixer. Then, the resultant mixture was subjected to cold isostatic press compacting (CIP compacting) at 90 MPa to be formed into a block. The block was then filled into a sagger and was then baked in a continuous furnace (900° C.). This compact was processed into a predetermined size, and the processed compact was defined as a carbon electrode of Example 1. Also, there were produced carbon electrodes for producing gaseous nitrogen trifluoride of Examples 2 to 7 and Comparative Examples 1 to 7 which have final physical properties shown in the following Table 1 in the same manner as in the Example 1 except the type and adjustment of addition rate of the metal fluoride. In the Comparative Example 7, the compacting pressure was set to 40 MPa in order to increase the average pore size.

TABLE 1

| | Contained Metal Fluoride | Content of Metal Fluoride (Wt %) | Bending Strength (Mpa) | Average Pore Size (μm) | Life of Electrode *1 | Difficulty of Generation of Polarization *2 | Yield of $NF_3$ *3 | Remarks |
|---|---|---|---|---|---|---|---|---|
| Example 1 | $AlF_3$ | 5.0 | 70 | 0.40 | ○ | ○ | ○ | — |
| Example 2 | $AlF_3$ | 3.1 | 80 | 0.35 | ○ | ○ | ○ | — |
| Example 3 | $AlF_3$ | 9.8 | 65 | 0.43 | ○ | ○ | ○ | — |
| Example 4 | $MgF_2$ | 3.0 | 95 | 0.18 | ○ | ○ | ○ | — |
| Example 5 | $MgF_2$ | 5.0 | 91 | 0.19 | ○ | ○ | ○ | — |
| Example 6 | $MgF_2$ | 10.0 | 85 | 0.18 | ○ | ○ | ○ | — |
| Example 7 | $AlF_3/MgF_2$ (0.5:0.5) | 5.0 | 80 | 0.21 | ○ | ○ | ○ | — |
| Comparative Example 1 | $AlF_3$ | 2.7 | 95 | 0.20 | Δ | x | x | — |
| Comparative Example 2 | $AlF_3$ | 10.8 | 55 | 0.40 | x | x | x | Electrode Disintegration |
| Comparative Example 3 | $MgF_2$ | 2.9 | 97 | 0.19 | x | x | x | — |
| Comparative Example 4 | $MgF_2$ | 10.3 | 80 | 0.25 | Δ | ○ | x | — |
| Comparative Example 5 | $CaF_2$ | 5.0 | 64 | 0.80 | x | ○ | ○ | Electrode Disintegration |
| Comparative Example 6 | LiF—$CaF_2$ (0.4:0.6) | 5.0 | 58 | 0.57 | x | ○ | ○ | — |
| Comparative Example 7 | $MgF_2$ | 5.0 | 40 | 1.70 | x | ○ | ○ | Electrode Disintegration |

*1: life
6 months or less x
6 months to 12 months Δ
12 months or more ○
*2: polarization
polarization may be generated x
polarization is extremely unlikely generated ○
*3: yield of $NF_3$
60% or less x
60% or more ○

An electrolyte of an $NH_4F$—KF—HF series was decomposed by an electric current using the carbon electrodes for producing gaseous nitrogen trifluoride which were produced by the above method and are shown in Table 1 to produce gaseous nitrogen trifluoride. Then, the yield of the gaseous nitrogen trifluoride, the existence of polarization of the carbon electrode and the life of the electrode, etc., were also investigated, and were included in Table 1.

The above Table 1 shows that the carbon electrode of each of the Examples which has an average pore size of 0.5 μm or less and contains aluminium fluoride and magnesium fluoride prevents the cause of a polarization. Also, the above Table 1 shows that the carbon electrode according to the invention provides an improved yield of the gaseous nitrogen trifluoride. In addition, the Table 1 shows that the carbon electrode of each of the Examples has a much longer life than that of the carbon electrode of each of the Comparative Examples.

What is claimed is:

1. A carbon electrode for producing gaseous nitrogen trifluoride, comprising a carbonaceous material, and at least one metal fluoride selected from the group consisting of magnesium fluoride and aluminum fluoride, wherein the carbon electrode has a dense structure comprising an average pore size of 0.5 μm or less, the at least one metal fluoride is contained in the structure of the carbon electrode, a melting point of the selected metal fluoride is not lower than a baking temperature of the carbonaceous material, and a content of the selected metal fluoride is 3 to 10 wt %.

2. The carbon electrode for producing gaseous nitrogen trifluoride according to claim 1 prepared by a method comprising cold isostatic press compacting and baking at a temperature of 800 to 1000° C.

* * * * *